US008146989B2

(12) United States Patent
Godiska et al.

(10) Patent No.: US 8,146,989 B2
(45) Date of Patent: Apr. 3, 2012

(54) CHILD SOOTHING DEVICE WITH A LOW FREQUENCY SOUND CHAMBER

(75) Inventors: James E. Godiska, Exton, PA (US); Joshua E. Clapper, Exeter, PA (US); Nick Efthemios Papageorge, Upper Darby, PA (US)

(73) Assignee: Graco Children's Products Inc., Atlanta, GA (US)

( * ) Notice: Subject to any disclaimer, the term of this patent is extended or adjusted under 35 U.S.C. 154(b) by 1043 days.

(21) Appl. No.: 12/055,770

(22) Filed: Mar. 26, 2008

(65) Prior Publication Data

US 2008/0240483 A1 Oct. 2, 2008

Related U.S. Application Data

(60) Provisional application No. 60/908,178, filed on Mar. 26, 2007.

(51) Int. Cl.
*A47C 7/62* (2006.01)
*H04R 1/02* (2006.01)
*H05K 5/00* (2006.01)

(52) U.S. Cl. ..... 297/217.4; 297/217.1; 297/217.5; 381/351; 381/352; 181/145

(58) Field of Classification Search ..... None
See application file for complete search history.

(56) References Cited

U.S. PATENT DOCUMENTS 4,819,761 A * 4/1989 Dick ..... 181/145
4,914,750 A * 4/1990 Lawson ..... 381/152
5,187,333 A * 2/1993 Adair ..... 181/152
6,378,940 B1 4/2002 Longoria et al.
6,854,799 B1 * 2/2005 Asbach et al. ..... 297/136
6,932,377 B2 * 8/2005 Bretschger et al. ..... 280/642
7,077,405 B2 * 7/2006 Akpom ..... 280/47.38
7,722,118 B2 * 5/2010 Bapst et al. ..... 297/256.12
2002/0140260 A1 * 10/2002 Osato ..... 297/217.4
2006/0023910 A1 * 2/2006 Tsutsumi ..... 381/351
2006/0269095 A1 11/2006 Matsumura et al.

(Continued)

FOREIGN PATENT DOCUMENTS

WO WO 2008/055252 5/2008

OTHER PUBLICATIONS

European Search Report issued in correspondence European patent application No. 0815337.4 mailed Jul. 31, 2008.

(Continued)

*Primary Examiner* — Elvin G Enad
*Assistant Examiner* — Mangtin Lian
(74) *Attorney, Agent, or Firm* — Lempia Summerfield Katz LLC

(57) ABSTRACT

A child soothing device includes a frame comprising a structural support, a housing coupled to the structural support and comprising a cover with an opening, and a speaker including a speaker driver and a speaker chamber. The speaker driver has a diaphragm disposed relative to the opening in the cover for external sound wave propagation via displacement of the diaphragm, and the speaker chamber has a volume defined by the housing and in communication with the diaphragm for internal sound wave propagation via the displacement of the diaphragm. The device further includes a partition within the housing to further define the volume of the speaker chamber. The volume may include a region obliquely oriented relative to the diaphragm to support a low frequency response of the speaker.

15 Claims, 13 Drawing Sheets

U.S. PATENT DOCUMENTS

2007/0111809 A1* 5/2007 Bellows et al. ..... 472/118

OTHER PUBLICATIONS

Zetek, "Infinite Baffle Subwoofer Design-Build Project," Affordable Audio electronic magazine, Issue No. 14, pp. cover, 38-40 (Feb. 2007).

"Loudspeaker Enclosure," en.wikipedia.org/wiki/Loudpeaker_enclosure, five pages (Jun. 2008).

Owner's Manual, Lovin' Hug™ swing, Graco Children's Products Inc., www.gracobaby.com, pp. 1-44 (Oct. 2007).

"Renderings—Speaker Chamber," Lovin' Hug™ swing, Greco Children's Products Inc, 8 sheets.

* cited by examiner

CHILD SOOTHING DEVICE WITH A LOW FREQUENCY SOUND CHAMBER

CROSS-REFERENCE TO RELATED APPLICATION

This application claims the benefit of U.S. provisional application Ser. No. 60/908,178, entitled "Child Soothing Device with a Low Frequency Sound Chamber" and filed Mar. 26, 2007, the entire disclosure of which is hereby expressly incorporated by reference.

BACKGROUND OF THE INVENTION

1. Field of the Disclosure

The present disclosure is generally directed to child soothing devices and other juvenile products, and more particularly to devices and products with audio functionality to soothe a child.

2. Description of Related Art

A variety of products for infant children have incorporated audio functionality for entertainment and other purposes. Usually music or sounds are produced from a recording stored on electronics via a speaker located near the child. In some cases, the speaker is mounted near a seat occupied by the child. Examples of these types of juvenile products include swings and bouncers. Other products, such as play mats or pens, or playards, provide music or sounds via a speaker located near a play area occupied by the child. Still other products incorporate the sound production into an entertainment unit engaged by the child during play. The entertainment unit often includes an activity table or platform in which a speaker is disposed.

These juvenile products are often designed to provide the option of producing sounds that an infant or child would find soothing. Sounds commonly considered soothing include lullaby melodies, ocean waves, and the noises made in other nature settings, like chirping crickets or birds, a frog pond, etc. Some products have attempted to provide soothing sounds and noise geared specifically toward infant children. To that end, juvenile products have attempted to reproduce the sound of a heartbeat, the theory being that the infant is accustomed to the heartbeat sounds present in utero, or within the womb. The Lovin' Hug™ swing commercially available from Graco Children's Products, Inc., the assignee of this application, is one example of a juvenile product that attempts to produce a heartbeat sound in the interest of soothing the child occupant of the swing.

The quality of the sound production in past juvenile products has frequently been poor. In some cases, an interest in utilizing inexpensive audio system components has led to inaccurate reproduction of sounds. Lack of accuracy may, in turn, lead to inefficacy in soothing infant children accustomed to specific sound characteristics.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

This disclosure is generally directed to infant child devices and juvenile products having audio functionality for soothing infant children via production of in utero sounds, i.e., the sounds present within the womb. In accordance with one aspect of the disclosure, the devices and products disclosed herein are generally configured to have a low frequency response to accurately produce these sounds. To that end, various aspects of the disclosure address the size, shape, arrangement and integration of a sound chamber to support the accurate reproduction of the womb sounds. In some cases, the orientation, positioning and integration of other aspects of the speaker may also be utilized to attain the desired sound characteristics. More generally, a number of aspects of the disclosed devices and products are directed to accurate low frequency sound production in a manner that is compatible with the overall size or shape (or form factor) of the devices or products, thereby avoiding the creation of external design constraints for the devices or products.

In some embodiments, the desired low frequency response is achieved via a device housing that defines a speaker chamber with a volume having a region obliquely oriented with respect to other components of the speaker. The oblique orientation and other aspects of the speaker chamber facilitate the compatibility of the low frequency speaker with the device housing. In this way, a speaker chamber of a suitable size (and/or other characteristics) despite its location within a juvenile product housing. Alternatively or additionally, the volume of the speaker chamber is greater than about 10 cubic inches to support a low frequency response of the speaker. More generally, the speaker chamber has a volume of sufficient size despite being defined in part by at least one wall or other partition within the device housing. The partition isolates and separates the speaker chamber from other device components disposed within the housing to avoid any detrimental effects on speaker performance.

Figure 1:
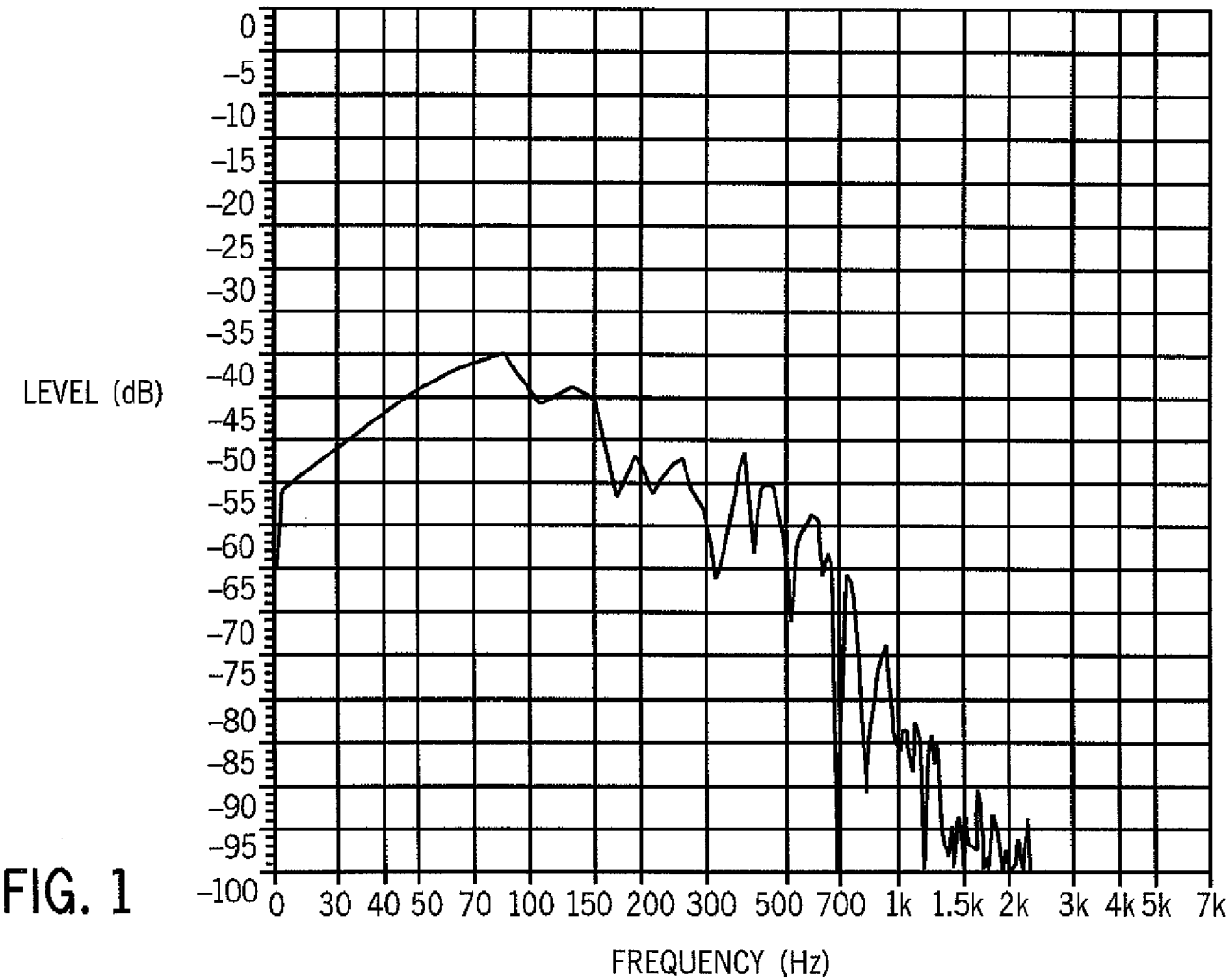
FIG. 1 shows a graphical plot of a representative frequency spectrum of the sounds arising from heartbeats and fluid motion in the womb.

Turning now to the drawing figures, the audio functionality of the devices and products disclosed herein is generally based on an identification or recognition of the fall frequency spectrum of the heartbeat and fluid motion sounds produced in the womb, a representative sample of which is depicted in FIG. 1. The frequency spectrum plot in FIG. 1 indicates that a significant amount of in utero sound is distributed within a low frequency range below about 80 Hz. In view of this distribution characteristic of the sound, the disclosed devices and products are generally configured for, and include components capable of, accurately reproducing low frequency sounds (e.g., below 80 Hz) at audible volumes and with minimal distortion. As described below, one challenge addressed by the disclosed designs involves the integration of low frequency components such as speaker enclosures within the various confines of infant child devices and juvenile products.

A number of types of speaker enclosure designs may be suitable for the reproduction of sound in such low frequency ranges. The examples set forth below are configured to incorporate these enclosure designs within the confines (e.g., a device housing) of a suitably sized infant child device or juvenile product. As described below, the disclosed devices and products include a housing arrangement to define an enclosure suitably sized for a given response shape to provide accurate low frequency extension and performance. Although some of the examples described below are directed to child motion devices (e.g., swings), each of the aspects of the disclosure is well suited for a wide variety of other infant child devices and juvenile products. Thus, the examples are provided below with the understanding that the invention is not limited to child motion devices or swings, but rather may be incorporated in other juvenile products in which a speaker enclosure and other audio-related components are integrated with other device or product housing arrangements.

Figure 2:
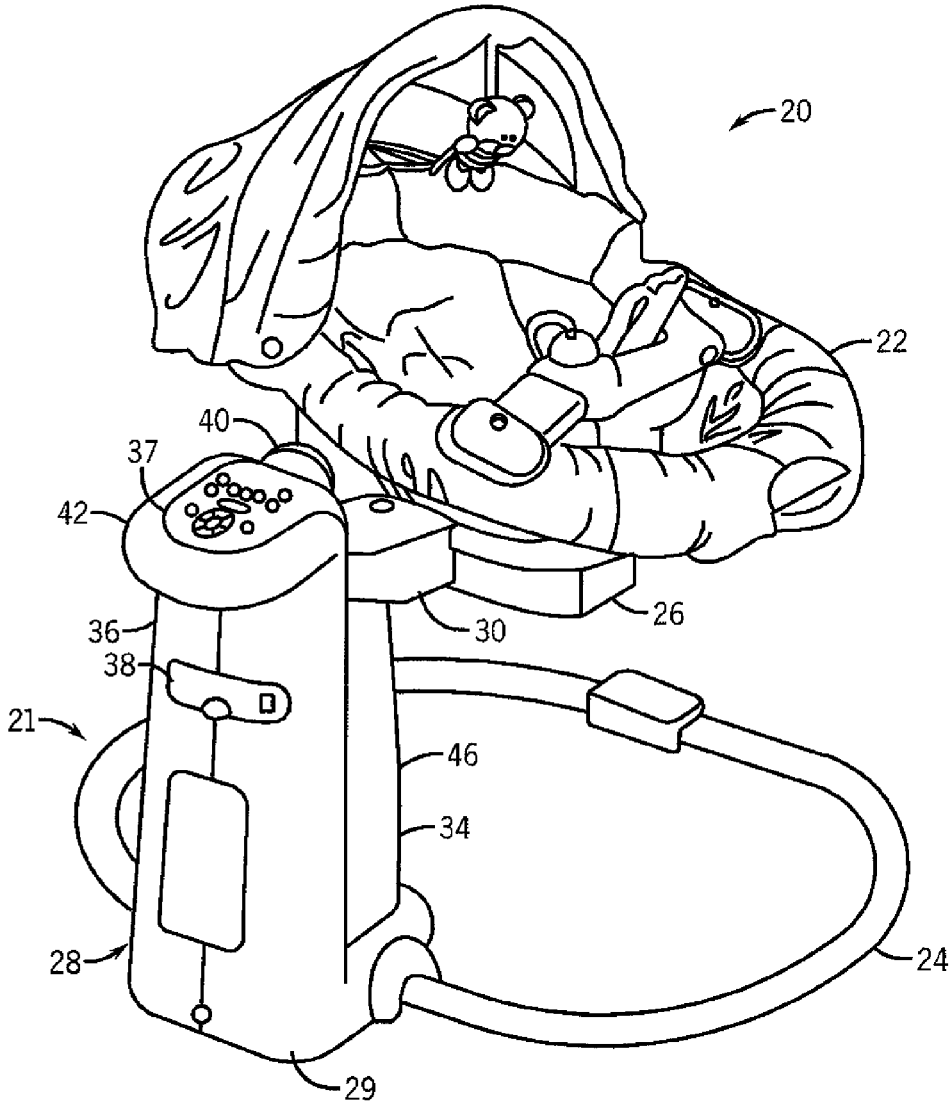
FIG. 2 is a perspective view of an exemplary juvenile product configured for audio functionality and sound production in accordance with various aspects of the disclosure.
Figure 3:
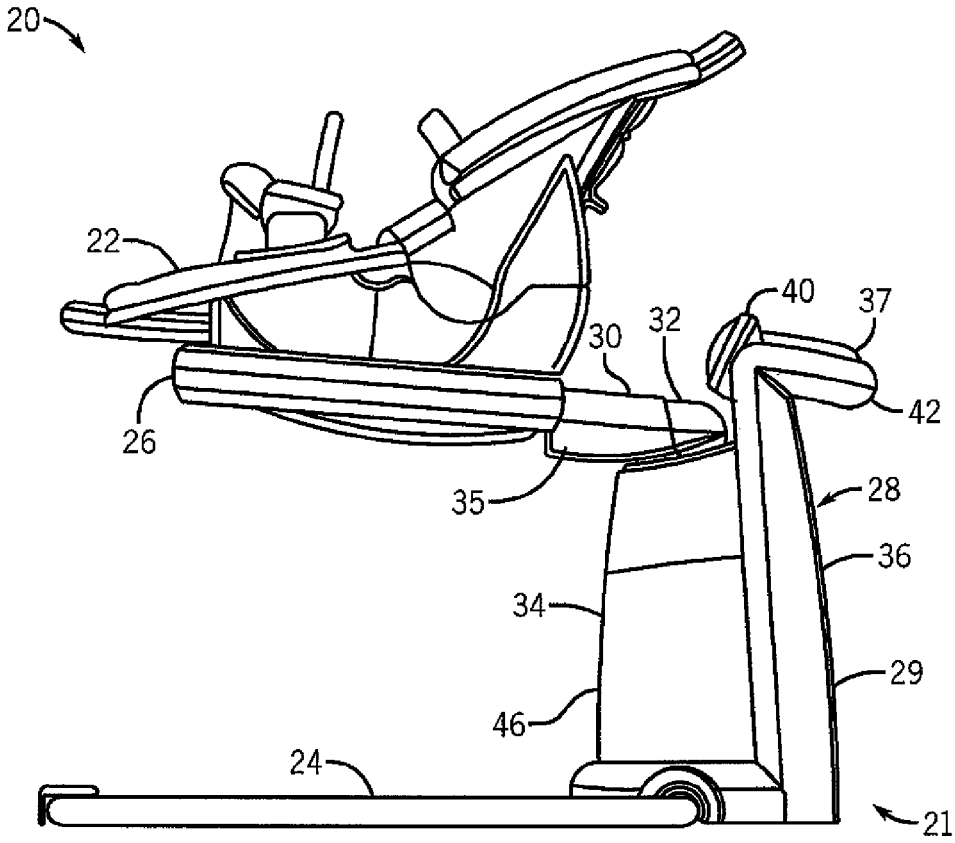
FIG. 3 is an elevational, side view of the juvenile product of FIG. 2.

FIGS. 2 and 3 show one example of a child motion device indicated generally at 20 and configured to incorporate various aspects of the disclosure. The device 20 in this example generally includes a frame assembly 21 configured to support an occupant seat 22 above the surface upon which the device 20 is disposed. A base section 24 of the frame assembly 21 rests upon the surface to provide a stable base for the device 20 while in-use. The frame assembly 21 also includes a seat support frame 26 on which the seat 22 is mounted. The seat frame 26 is generally suspended over the base section 24 to allow reciprocating movement of the seat 22 during operation. To that end, an upright post 28 of the frame assembly 21 extends upward from the base section 24 to act as a spine from which a support arm 30 extends radially outward to meet the seat frame 26.

In this example, the post or spine 28 is oriented in a generally vertical orientation relative to its longitudinal length. The post 28 has an external housing 29 that may be configured in any desired or suitable manner to provide a pleasing or desired aesthetic appearance. The housing 29 can be both functional and ornamental in a number of ways. For instance, the housing 29 can, act as a protective cover for the internal components, such as the drive system, of the device 20. Some or all of the housing 29 may constitute a removable cover for access to the interior or inner workings of the device 20, if needed. Still further, some of the housing 29 may define part of a speaker enclosure to support audio functionality, as described further below. In any case, the housing 29 and, more generally, the post 28, may vary considerably in orientation, shape, size, configuration, and the like from the examples disclosed herein.

Other components of the frame assembly 21, such as the base section 24, may also vary considerably in orientation, size, shape, configuration, and the like. Practice of the disclosed invention is not limited to the configuration of the exemplary frame assembly 21 described and shown in connection with FIGS. 2 and 3. Notwithstanding the foregoing, one or more components of the frame assembly 21 may be well suited for implementation of one or more aspects of the disclosure, as described below.

As best shown in FIG. 3, a driven end 32 of the support arm 30 is coupled to a mechanical portion 34 of the post 28 generally directed to structural support and the drive mechanism. In this example, the support arm 30 is cantilevered from the post 28 at the driven end 32. The support arm 30 is mounted for pivotal, side-to-side movement about its driven end 32 through a travel path that is substantially horizontal. Further details regarding the travel path, as well as other exemplary travel paths, can be found in U.S. Patent Publication No. 2007/0111809, entitled "Child Motion Device," the entire disclosure of which is hereby incorporated by reference. As described therein, the support arm 30 can travel through a partial orbit or arc segment of a predetermined angle and can rotate about an axis of rotation that can be offset from a vertical reference and that can be offset from an axis of the post 28. Alternatively, the axis of rotation can be aligned with the vertical reference, the axis of the post 28, or both, if desired. More generally, the driven end 32 is coupled to a drive system (not shown) disposed within the housing 29 and designed to reciprocate or oscillate a distal end 35 of the support arm 30 to which the seat frame 26 is attached for corresponding movement of the occupant seat 22.

The device 20 includes a number of components directed to controlling and/or facilitating the motion and other functionality of the device 20. In the example shown, several of these control components are disposed on or in a control tower 36 of the post 28. In some cases, the control tower 36 may also contain portions of the drive system or structural support elements of the device 20. In this example, the control tower 36 has an upper or top panel 37 to present an instrumentation, or control, interface to a caregiver directing the operation of the device 20. The control tower 36 also includes a slidable drawer 38 (FIG. 2) to provide a compartment for an MP3 player or other device on which music or sounds are stored for playback by a speaker 40 disposed near an upper deck or platform 42 extending laterally from the remainder of the tower 36. In this example, the lateral extension of the deck 42 provides a platform to support and orient the panel 37 in a convenient manner for a caregiver.

Device control electronics (not shown) may be disposed within the deck or platform 42 of the control tower 36. The electronics may be configured to respond to control signals from the control panel 37 to direct the operation of the device 20. For example, the electronics may include a memory storing any number of sound or music recordings for playback. To this end, the electronics may include an amplifier and other components directed to developing an audio output signal for the speaker 40. The electronics may alternatively or additionally control the audio functionality of the device 20 via an MP3 player or other playback device. A connection port or interface in the drawer 38 may couple the playback device to the electronics, directly to the speaker 40, or both, to support further audio functionality of the device 20. While the control electronics may be conveniently disposed within the deck or platform 42 of the control tower 36, the positioning and configuration of the electronics, instrumentation, user interface elements and other components related to the operational control of the device 20 may vary considerably from that shown. For instance, the instrumentation need not be arranged in a single panel, but rather may be distributed over multiple locations on the control tower 36 or other component of the device 20. Similarly, the device 20 may include any number of controllers, processors, circuit boards and other electronics components directed to controlling any one or more device functions or operations, as desired.

Figure 4:
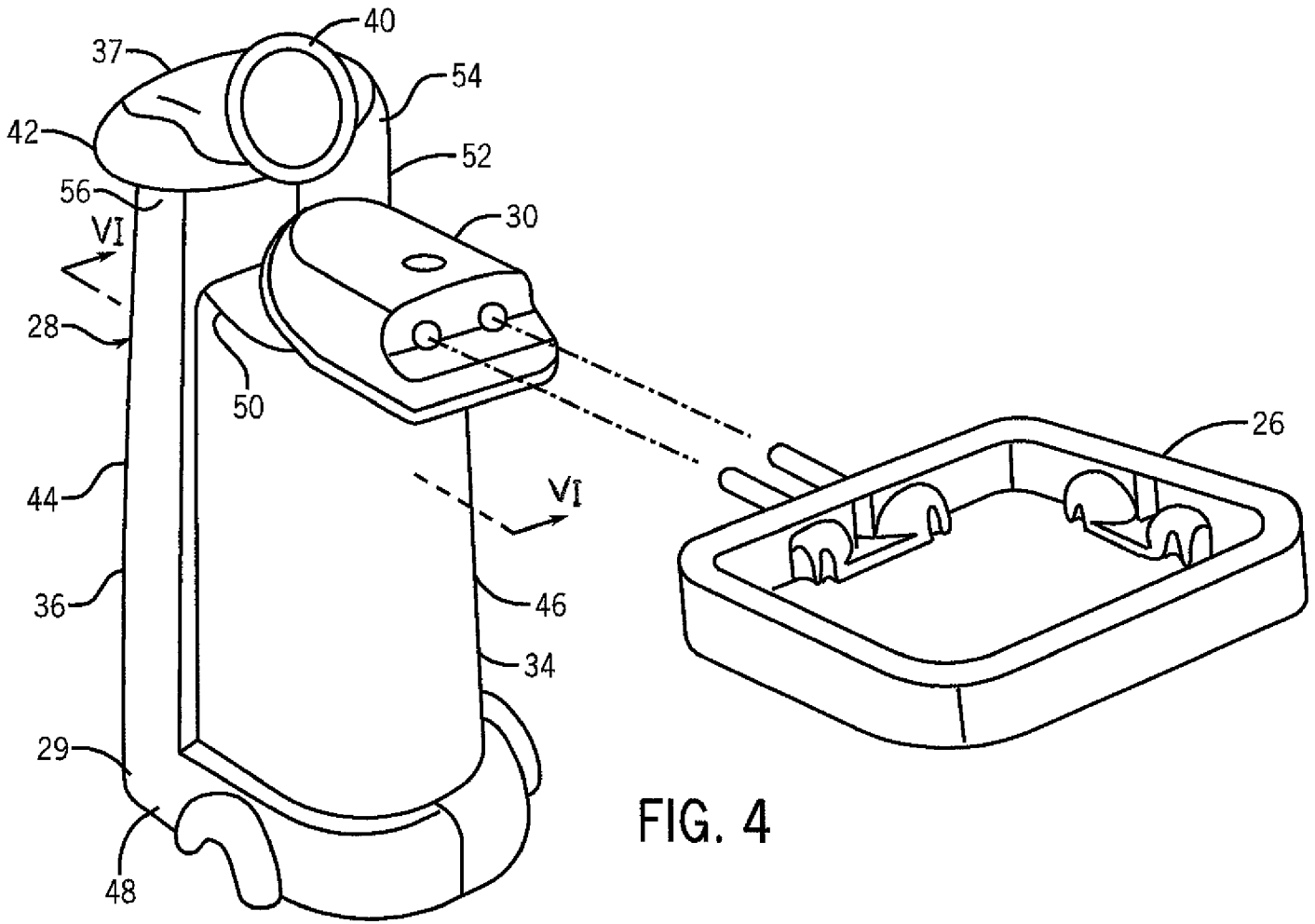
FIG. 4 is an exploded, perspective view of a post assembly of the juvenile product of FIG. 2.

FIG. 4 shows the post 28 in greater detail. In this example, the housing 29 of the post 28 includes a cover 44 for the control tower 36 and a cover 46 for the structural support and drive mechanism portion 34 of the post 28. Each of the covers 44, 46 rest on a footer or base cover 48. The covers 44, 46, 48 may be integrated to any desired extent. In some cases, one or more of the covers 44, 46, 48 act as part of the device frame by providing structural support. On the other hand, one or more of the covers 44, 46, 48 may instead be directed to enclosing support structure components, as described below in connection with the cover 46. In either case, one or more of the covers 44, 46, 48 may be formed from multiple components, such as two halves that mate to form a common shell, as shown in a number of the figures described below.

Generally speaking, each of the covers 44, 46, 48 may enclose any number of components of the device 20 directed to a wide variety of functions apart from the audio functionality of the device 20. Examples of the functions can vary greatly depending on the type of device or product. In this example, however, the functions include mechanical support, drive mechanisms, power supply, MP3 player storage, and control electronics, among other possibilities. As described below, one aspect of the disclosure is generally directed to isolating and separating a speaker chamber from the components directed to these other device functions to support a desired low frequency response.

As shown in FIGS. 2-4, the control tower 36 of the post 28 acts as a riser to position the speaker 40 at a height suitable for directing sound waves at the child. More specifically, the housing 29 is wider near the base cover 48, where the control tower 36 and the structural support portion 34 of the post 28 are adjacent. The portion 34 forms a ledge or shelf 50 of the post 28 on which the support arm 30 pivots to reciprocate the seat frame 26. Above that height, the housing 29 narrows to form a neck or riser portion 52 of the control tower 36. The neck 52 generally supports the speaker 40 and the platform 42 at a height above the ledge 50, the support arm 30, and other components of the device 20. In this way, sound waves propagating from the speaker 40 can proceed unobstructed to the child. The length of the neck 52 may also dispose the platform 42 at a more convenient height for a caregiver accessing the control panel 37.

The speaker 40 is mounted on the housing 29 in manner that also advantageously directs the sound waves toward the child. In this example, the speaker 40 is mounted in an opening in the cover 44 and/or the platform 42 in a direction corresponding with the midpoint of the motion path or arc. In this way, sound waves disperse from the speaker 40 for relatively uniform distribution over the entire motion path. The speaker 40 may also be mounted at a slight upward tilt or incline, as best shown in FIG. 3, for further sound wave directionality. The orientation of the speaker 40 may also facilitate the production of low frequency sound, as described below in connection with the interaction of the speaker 40 with a speaker chamber within the housing 29.

The shape, size and other characteristics of the neck or riser portion 52 of the control tower 36 may also be directed to supporting the audio functionality of the device 20. As described in detail below, the neck or riser portion 52 of the control tower 36 (or any other portion of the housing 29) may provide internal space for an enclosure or chamber within the housing 29 to support a low frequency response of the speaker 40. To maximize the size of the space, one or more sections of the cover 44 may contribute to the definition of the enclosure. To that end, the sections of the cover 44 in the neck or riser portion 52 of the control tower 36 may be symmetrically configured and arranged as a rectangular or other cylinder. In this example, the cover 44 in the neck or riser portion 52 has a pair of generally flat, opposing surfaces 54 joined by two side panels 56. The interfaces between the surfaces 54 and the side panels 56 may include a curved, rounded, or otherwise smooth transition instead of forming a squared edge.

Figure 5:
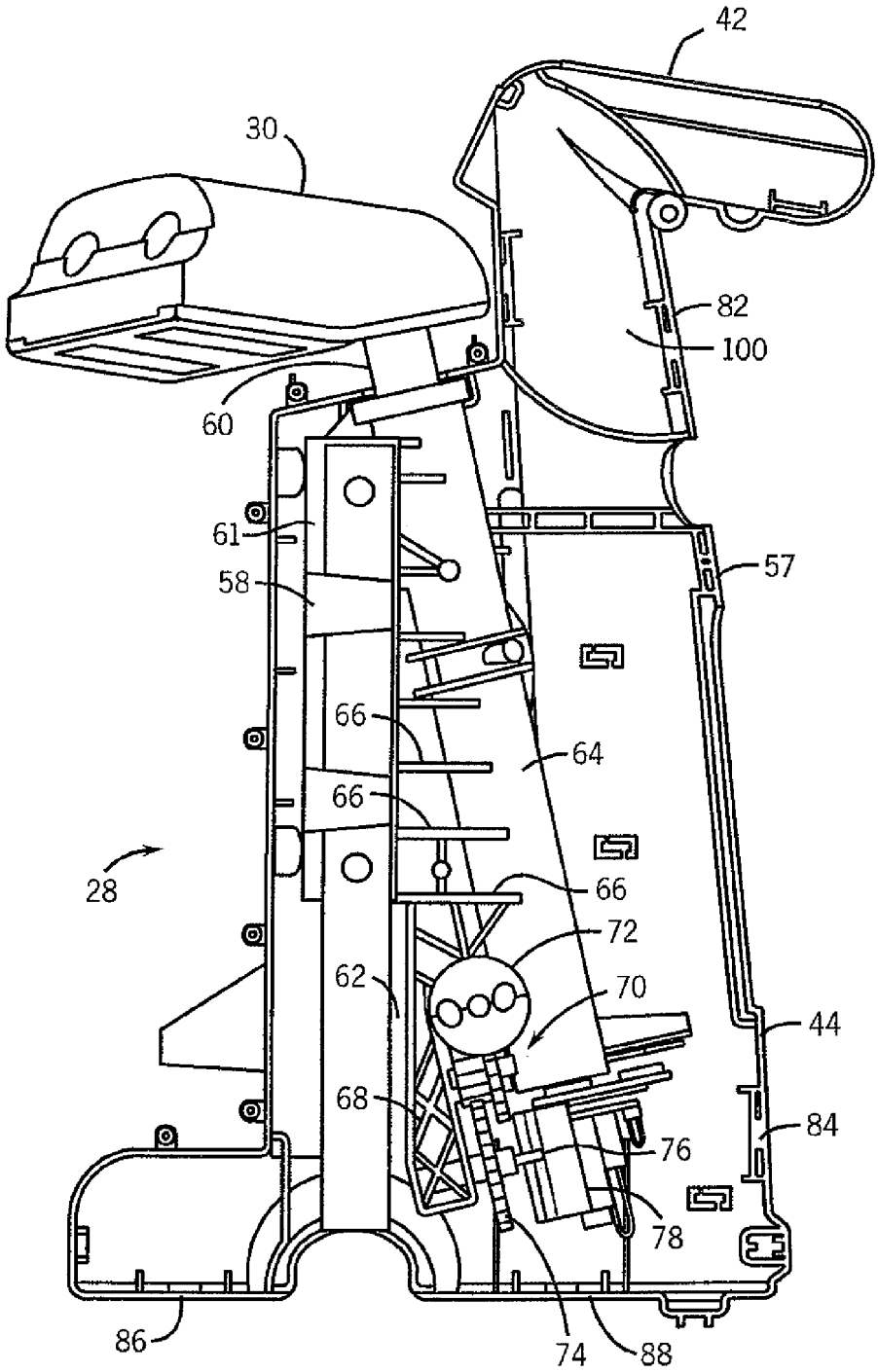
FIG. 5 is a cutaway, side view of the post assembly of FIG. 4 to depict internal components of the juvenile product, including an exemplary speaker chamber configured in accordance with one aspect of the disclosure.
Figure 6:
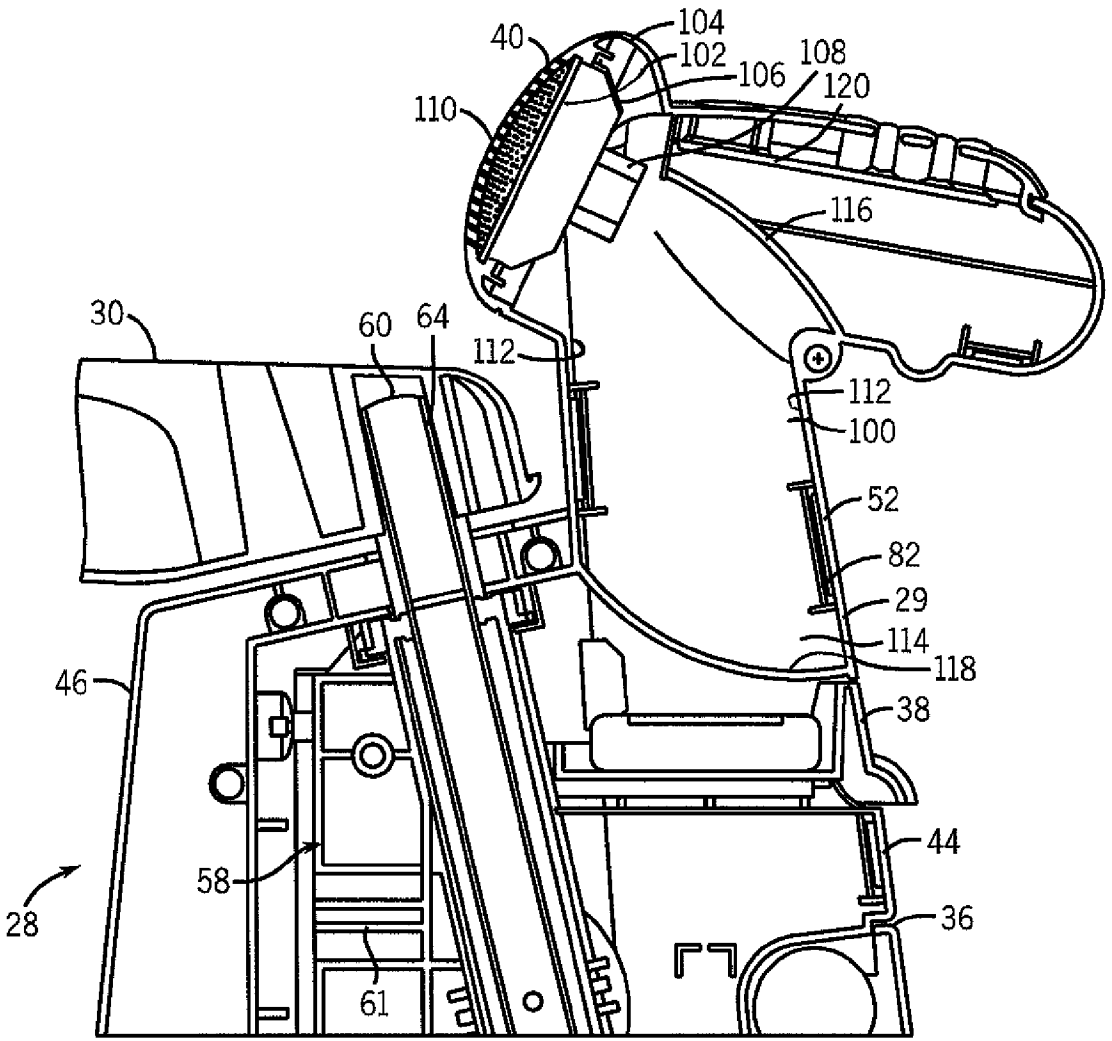
FIG. 6 is a partial, sectional view of the juvenile product post assembly of FIG. 4 taken along lines VI-VI of FIG. 4 to depict the speaker chamber in greater detail.
Figure 7:
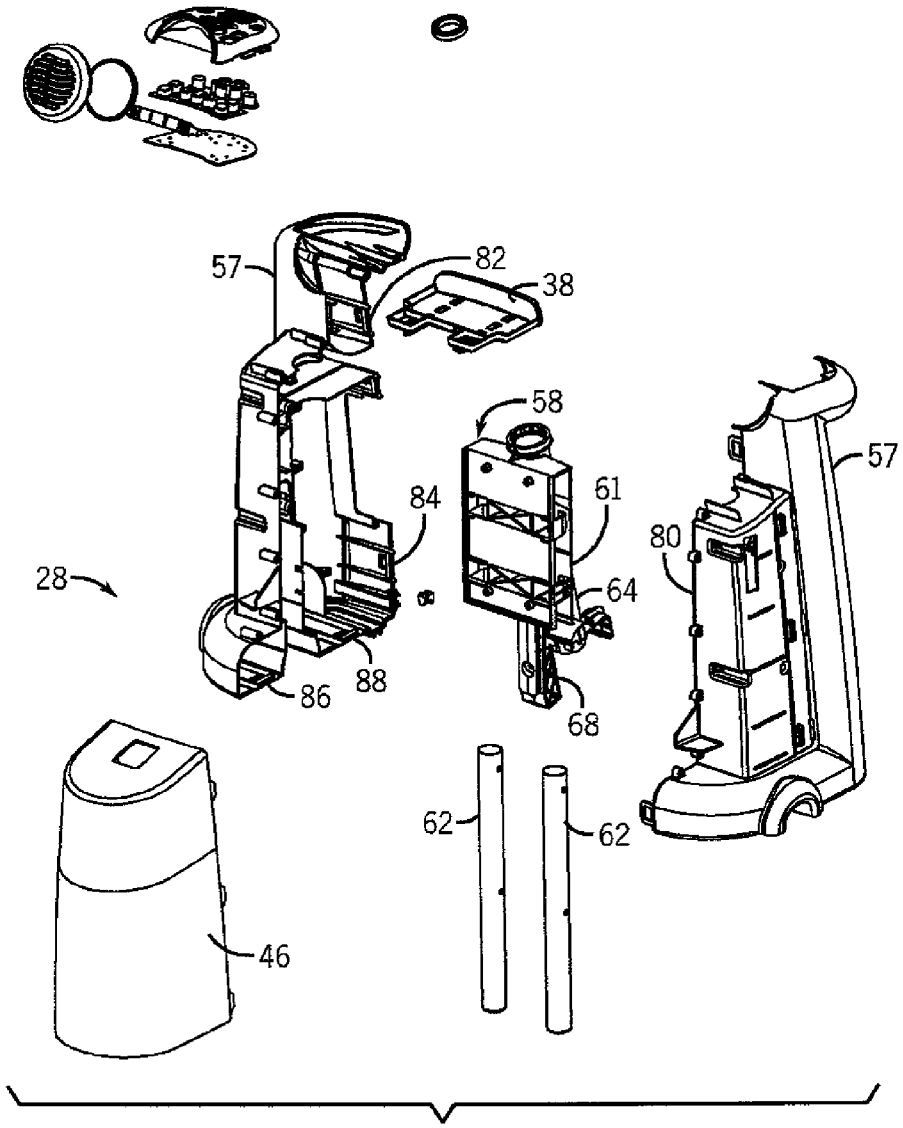
FIG. 7 is an exploded, perspective view of a juvenile product post assembly in accordance with an exemplary embodiment.
Figure 8:
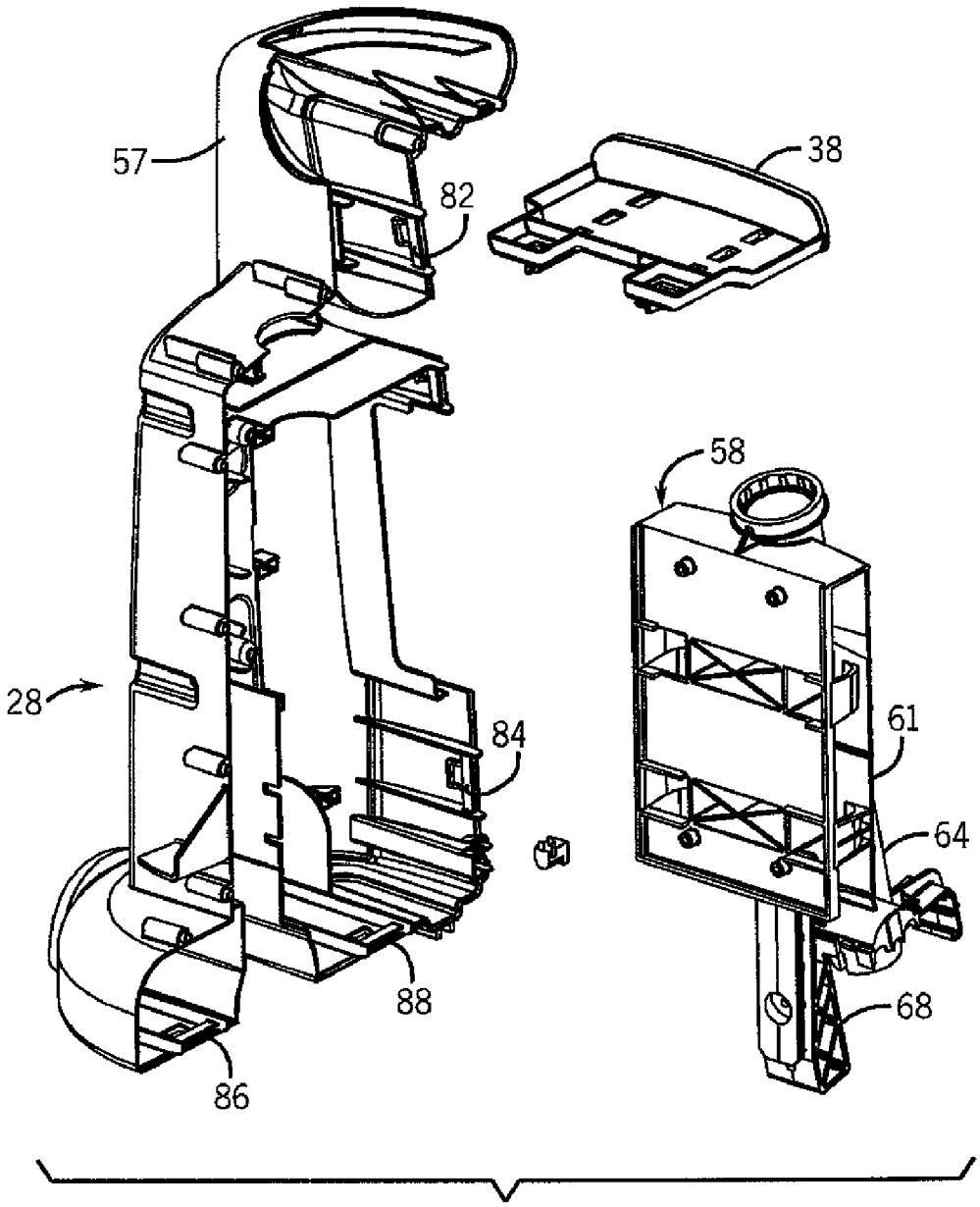
FIG. 8 is a partial, perspective view of the juvenile product post assembly of FIG. 7 to depict a housing component and a support structure of the juvenile product in greater detail.

Turning to FIGS. 5-8, where elements in common with other figures are indicated with like reference numerals, the post 28 is shown in a number of different views as an assembly involving a complex arrangement of external and internal components for supporting and driving the swinging or swaying motion. The assembly is only briefly described herein, as the manner in which the device 20 is structurally supported and mechanically driven may vary considerably. For ease in illustration, the post assembly is shown in FIG. 5 without the cover 46 and with one of two halves 57 of the cover 44 removed to reveal the internal components. FIGS. 7 and 8 depict the post assembly in exploded form, with FIG. 8 showing one of the two halves 57 of the cover 44 and a support structure 58 in greater detail. For ease in illustration, the post assembly is shown in FIGS. 7 and 8 without the support arm 30 or a drive shaft 60 (see instead FIGS. 5 and 6) coupled thereto. The drive shaft 60 may generally include a tube-shaped rod to transfer motion to the support arm 30.

In this example, the support structure 58 includes a cage 61 that accepts a pair of support columns or posts 62 (FIGS. 5 and 7), orienting them in a generally upright direction. The support structure 58 also includes an inclined sleeve 64 configured to support rotation of the drive shaft 60, as well as a set of ribs 66 (FIG. 5) to support the sleeve 64. The shaft 60 extends upward at an angle relative to the generally upright columns 62 to reach the support arm 30 after extending beyond the sleeve 64. The support structure 58 still further includes a lower support frame 68 for a number of components of a drive system indicated generally at 70 (FIG. 5).

As best shown in FIG. 5, the drive system 70 may generally operate in the following manner to create the swaying motion of the device 20. A DC electric motor 72 drives a gear train 74 that carries a pin or bolt 76, which, in turn, acts as a crank shaft for a vertically oriented slot of a U-shaped or notched bracket 78 coupled to the shaft 60. In this way, movement of the pin 76 is transformed from pure rotary motion into the oscillating or reciprocating motion of the shaft 60. In some cases, the energy of the crank shaft is transferred via a spring (not shown) that acts as a rotary dampening mechanism as well as an energy reservoir. The spring can be implemented to function as a clutch-like element to protect the motor 72 by allowing out-of-sync motion between the motor 72 and the shaft 60.

As best shown in FIG. 7, the components of the support structure 58 (and, thus, the drive system 70) are generally disposed within a holder 80. When mated with other portions on the other half 57 of the cover 44, or housing 29, the holder 80 forms an enclosure to secure the internal components in position.

The two halves 57 of the cover 44 may be held in position by a snap-fit connections or other fastener mechanisms. In this example, the connection is established via an upper pair of cooperating fasteners 82 and a lower pair of cooperating fasteners 84, each of which is located along the tower 36. Similar fasteners 86, 88 may be located in the base cover of the housing 29. More generally, these fastening or connection mechanisms are directed to providing a tight fit for the housing 29, which may lead to an acoustic seal that supports the production of low frequency sounds in accordance with one aspect of the disclosure.

With reference again to FIG. 6, the components of the speaker 40 are described in greater detail. Generally speaking, the speaker 40, or driver, includes a speaker chamber 100 to support the production of low frequency sounds, such as those produced in utero. To that end, the speaker chamber 100 has a volume in communication with a diaphragm 102 of the speaker 40. In operation, the air pressure fluctuations, or compression and rarefaction, produced by the displacement or movement of the diaphragm 102 result in the propagation of sound waves within the chamber 100. The chamber 100 may then be configured to create sound waves that enhance the low frequency response of the speaker 40. The description of the examples to follow is provided with the understanding that the disclosed devices may utilize any number of speakers or drivers, as well as any number of speaker chambers.

The diaphragm 102 is generally disposed in a location to facilitate the outward or external propagation of sound waves resulting from the displacement of the diaphragm 102. To that end, the diaphragm 102 is suitably located relative to an opening 104 in the housing 29. In this example, the diaphragm 102 is disposed near or at the opening 104. The round shape of the opening 104 corresponds with the shape of the diaphragm 102, which may also help to securely position the diaphragm 102 and other components of the speaker 40 to the housing 29. In other examples, this correspondence need not be the case, as the diaphragm 102 may be located at an internal position within the housing 29, in which case a conduit or other passage may be formed to support the external sound wave propagation. More generally, the diaphragm 102 is mounted on a supporting basket or frame 106 about a magnet assembly 108 to displace the diaphragm 102. In this example, the diaphragm 102 includes a flexible cone disposed behind a protective grill or cover 110. The grill 110 in this example has a surface perforated with an array of holes to facilitate the external sound wave propagation. The holes may be configured uniformly or in varying ways, but, in some cases, it may be useful to form the holes such that a minimum hole diameter is no less than the thickness of the material of the grill 110. In some cases, the diaphragm 102 is inverted to form a dome, and need not include a cover if, for instance, the diaphragm 102 is internally disposed. The speaker 40 may include additional components, such as a suspension or surround (not shown) that forms a rim of flexible material between the diaphragm 102 and the basket 106.

The speaker chamber 100 generally includes a volume defined in part by one or more surfaces of the housing 29 and in part by one or more walls or other partitions disposed within the housing 29. More specifically, the volume is generally defined within the neck or riser portion 52 of the control tower 36. As a result, the volume has a generally rectangular cylindrical shape, although, in alternative embodiments, the shape of the volume need not track the external shape of the housing 29 to the same extent. In this example, however, the volume is, in fact, defined by internal surfaces 112 corresponding with the external surfaces 54 (FIG. 4) and by internal surfaces 114 corresponding with the side panels 56 (FIG. 4). The volume is further defined by an upper wall 116 and a lower wall 118 disposed generally at ends of the neck 52. Each of the walls 116, 118 has a curved shape to establish a smooth partition of the space within the housing 29. The interior surfaces of the walls 116, 118 (as well as the other surfaces 112, 114) may also be formed of a smooth material (e.g., a rigid polymer such as Acrylonitrile butadiene styrene, or ABS). Together, the shape and material properties of these partitions and defining surfaces may facilitate the desirable sound wave propagation within the speaker chamber 100.

One or more of the surfaces defining the speaker chamber 100 generally act as partitions to acoustically isolate the sound waves propagating within the speaker chamber 100. That is, the surfaces and other aspects of the housing 29 generally separate the structural and mechanical components of the device 20 from the acoustic components. In this example, the volume of the speaker chamber 100 is also defined in part by a generally vertical wall 120 near the opening 104 and within the platform 42. The wall 120 meets the upper wall 116 to separate the speaker chamber 100 from any electronics or other components housed within the platform 42. In this way, the platform components will not adversely affect the frequency response of the speaker 40 or otherwise degrade the performance of the speaker 40. At the other end of the speaker chamber 100, the wall 118 forms a partition separating the speaker chamber 100 from the numerous objects and structures providing structural support and supporting other device functions, such as the drive mechanism described above. In alternative embodiments, the partitions may be objects other than walls dedicated to separating the space within the volume. To this end, the acoustic properties of the walls or other objects may be considered.

In accordance with one aspect of the disclosure, the speaker chamber 100 is configured as an open, uncluttered volume generally free of structural or mechanical components. With the partitioning walls 116, 118 separating and isolating the speaker chamber 100 from the complexities found in the remainder of the internal space, objects like the MP3 drawer 38, a circuit board (not shown) of the control electronics, battery power sources (not shown), the DC motor 72, and the support structure 58 do not provide obstructions to the sound wave propagation. The volume of the speaker chamber 100 is configured to also be generally free of other obstructions. As shown in the example of FIG. 6, the volume is substantially empty, having only the snap-fit connector or fastener 82. Moreover, any wires (not shown) running from the motor 72 or the MP3 drawer 38 may be integrated with one of the surfaces 112 or 114. For example, the surface 112 may include one or more grooves or ribs (not shown) in which wires are disposed. In other cases, the wires may be completely encased or covered.

The shape and size of the exemplary speaker chamber 100 shown in FIG. 6 also illustrate further aspects of the disclosure. Generally speaking, the size of the speaker chamber 100 may be of interest to support a desired low frequency response, insofar as such frequency ranges may involve the movement or displacement of a large mass of air. That said, working within the geometric and other confines, or form factor, of the housing 29 may provide limitations on available space. Moreover, the isolation and separation of the speaker chamber 100 from the other device components may also be a limiting factor. Still further, the positioning of the diaphragm 102 of the speaker 40 may also limit the location of the speaker chamber 100 to certain positions within the housing 29. In this example, the speaker chamber 100 addresses these challenges through an oblique orientation of the chamber volume. More specifically, the volume, or a region thereof, is obliquely oriented relative to the diaphragm 102. As shown in FIG. 6, a primary dimension or axis of the speaker chamber 100 is not aligned with the orientation of the diaphragm 102, which generally determines the initial direction of the backward sound wave propagation. The speaker chamber 100 defines a generally cylindrical volume vertically oriented to fit within the form factor of the neck or riser portion 52, rather than being oriented along the incline of the diaphragm 102. Thus, the circumference of the cone of the diaphragm 102 generally defines a circular cylinder oriented transversely to the plane of the opening in the housing 29. As a result, a lower region of the speaker chamber 100 that does not overlap that circular cylinder is not located directly behind the diaphragm 102, leaving the volume crooked or convoluted relative to the diaphragm 102. The curvature of the upper 116 may minimize any disadvantages arising from the propagation of sound waves through a convoluted path into this unaligned region. In other examples, with a different device form factor and device housing shape, the speaker chamber need not have a region obliquely oriented relative to the speaker diaphragm.

In some speaker configurations, the speaker chamber 100 has a generally large size to support the production of low frequency sound. The oblique orientation of the chamber 100 may help achieve a desired size despite the partitioning of the space within the housing 29 and other limiting factors. More generally, to support frequencies below about 80 Hz, the inner space with the housing 29 is generally utilized to attain a volume greater than 10 cubic inches. This parameter value was determined through a series of sound production tests involving tube-shaped speaker enclosures of varying volume. The volume size, however, may vary with the size of other speaker components, such as the diameter of the diaphragm 102. For instance, with a diaphragm diameter of approximately 65 mm, it may be useful to configure the speaker chamber 100 to have a volume in a range from about 35 cubic inches to about 140 cubic inches, with one example within that range being about 72 cubic inches (i.e., roughly a 6×6×2 volume). Above about 400 cubic inches, any further increases may tend not to provide much benefit, as the design begins to act like an infinite baffle. Other factors that may lead to a desired chamber volume include the materials used for the speaker surround (e.g., foam or soft rubber), differences in the desired or target frequency range, and modifications to incorporate a different speaker configuration (e.g., bass reflex enclosures), a number of suitable alternatives of which are described below. In one example, significantly enhanced frequency response may result from incorporating a 1 inch tubed port having a length of 2.75 inches, in which case the chamber size guidance would change accordingly.

Figure 9:
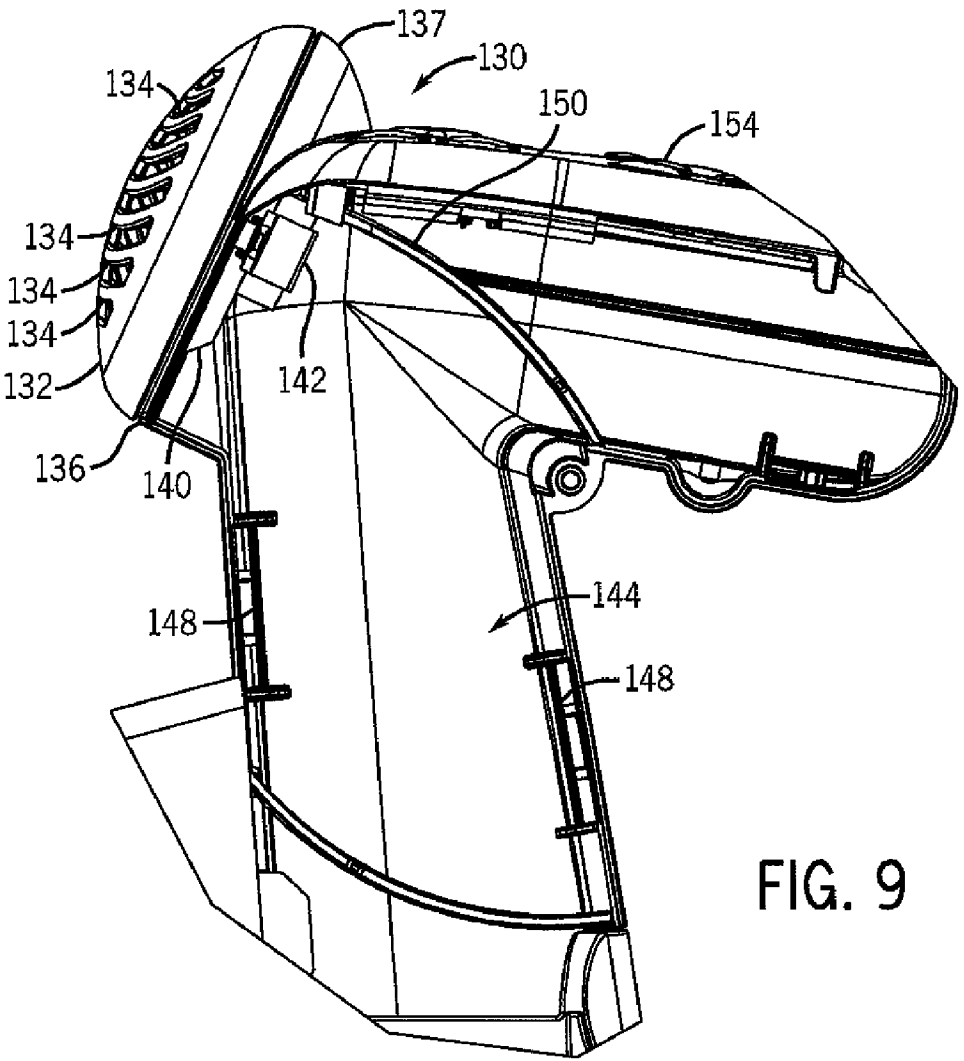
FIG. 9 is a partial, cutaway of an upper portion of the juvenile product post assembly of FIG. 7 to depict an exemplary speaker of the juvenile product in greater detail.
Figure 10:
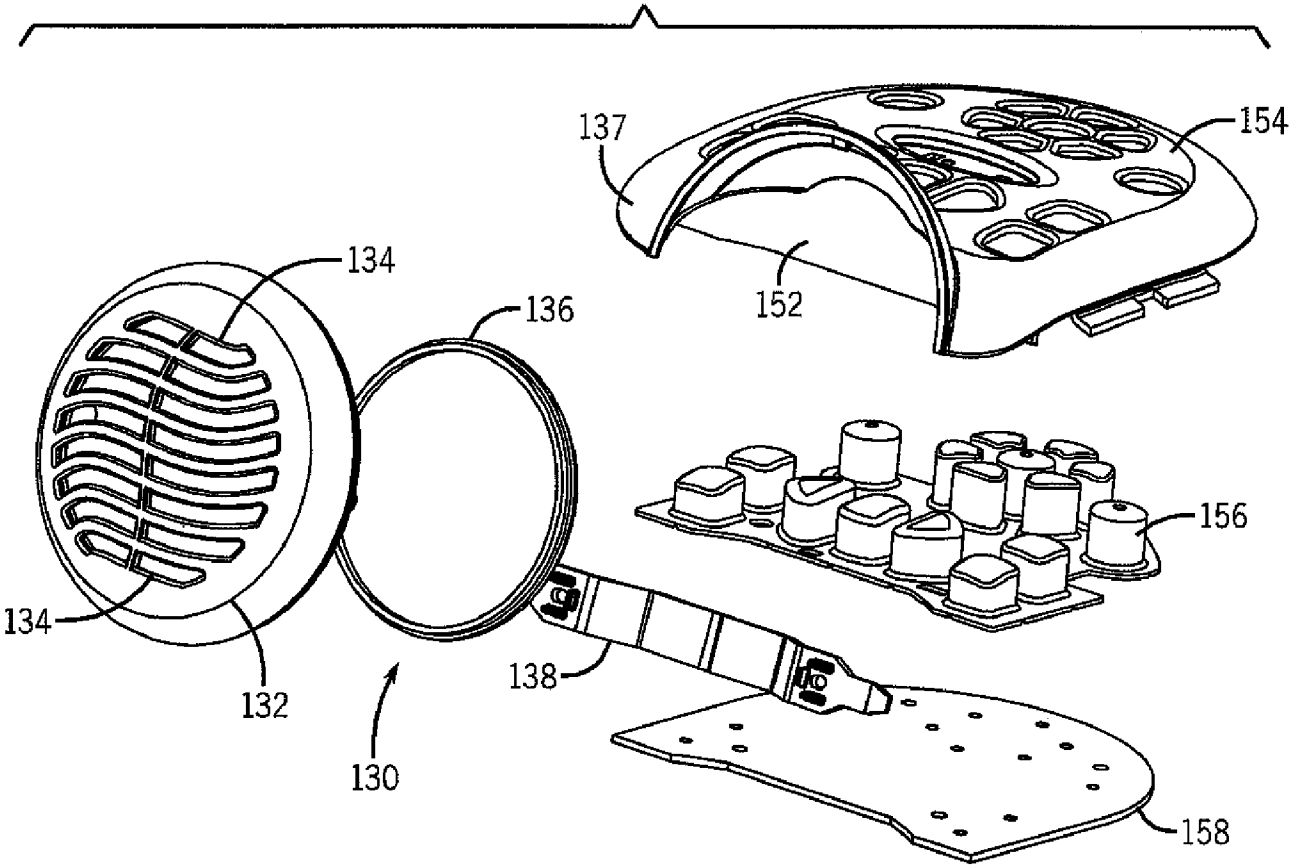
FIG. 10 is a partial, exploded view of the upper portion of the juvenile product post assembly shown in FIG. 9 to depict an exemplary user interface control panel and speaker arrangement in accordance with one aspect of the disclosure.

With reference now to FIGS. 9 and 10, an alternative speaker assembly indicated generally at 130 includes a grill or cover 132 with a plurality of slots 134 formed therein. The slots 134 may allow higher amplitude sound waves propagating outward from the speaker assembly 130, as well as advantageously modify the frequency response by avoiding any distortion arising from air passing through pinholes. Whether relying on holes or slots, the grill 132 may be configured to be open to an extent from about 28% to about 50%. This range of grill openness provides an adequate degree of protection from unwarranted access to the interior of the speakers while achieving acceptable sound quality. In these and other cases, the edges of the openings (e.g., slots or holes) may be rounded off to facilitate airflow and, thus, improve sound quality. The speaker assembly 130 also includes a bead or rim 136 to form a tight fit between the grill 132 and remainder of the speaker assembly 130. The tight fit helps to minimize any undesired vibration of the speaker components and any adjacent surfaces of a housing 137 (or component thereof), which could otherwise result in a rattle or other noise that distorts the frequency response. To that end, a strap 138 (FIG. 10) is used to secure a basket 140 (FIG. 9) and magnet assembly 142 (FIG. 9) against the housing 137.

The strap 138 and other components of the speaker assembly 130 may also generally support an acoustic seal of a speaker chamber indicated generally at 144 (FIG. 9) and disposed in communication with the diaphragm (not shown) of the speaker assembly 130. The speaker chamber 144 may be defined, isolated and otherwise configured in a manner similar to that described above in connection with the examples of FIG. 6. In these cases, the speaker chamber 144 may be further configured as a generally sealed enclosure, thereby forming an infinite baffle, closed-box enclosure design, as described further below. To this end, fasteners or connectors 148 similar to those described above may be used to secure a tight connection between halves or other portions of the housing 137. An interface between partitioning walls 150 (FIG. 9) and 152 (FIG. 10) may also be air-tight to avoid any pressure loss via a user interface panel 154 of the housing 137. Even though further sealing may be provided by the engagement of the panel 154 with a rubberized or otherwise flexible sub-platform 156 that provides a number of user select buttons, the partition walls 150, 152 may also avoid any complications arising from sound wave interaction with the user interface control panel components, including any associated electronics on a circuit board 158.

In some cases, the above-described acoustic seal of the speaker chamber 144 is not hermetic, yet still relatively sealed to support a suitable transient pressure response of the speaker assembly 130. In either case, the seal generally allows pressure to build up behind the diaphragm, thereby loading the diaphragm with the resonant system established via the size, shape and other characteristics of the speaker chamber 144. In alternative cases, the speaker configuration may not be sealed, but rather be configured to act as a bandpass speaker enclosure.

A number of alternative enclosure designs are suitable, and can be developed and tuned with speakers. In each case, the enclosure designs are implemented within the confines of a suitably sized infant product, such as the enclosure defined by the housing of the child swing described above. These potential enclosure designs include woofer and subwoofer enclosures, closed-box enclosures, reflex enclosures, passive radiator enclosures, compound or bandpass enclosures, and transmission line enclosures, each of which is addressed below.

Types of speaker chambers or enclosures used for woofers and subwoofers can be adapted for performance in the low frequency range(s) of interest (e.g., approximately 30-150 Hz as well as below 30 Hz as shown in FIG. 1), as well as for integration in the child soothing devices disclosed herein, using acoustics and the lumped component model. Conventional electrical filter theory may generally be used in the modeling. For the purposes of this type of analysis, each enclosure may be considered to have a loudspeaker topology. Several examples of suitable enclosure designs are described below.

Figure 11:
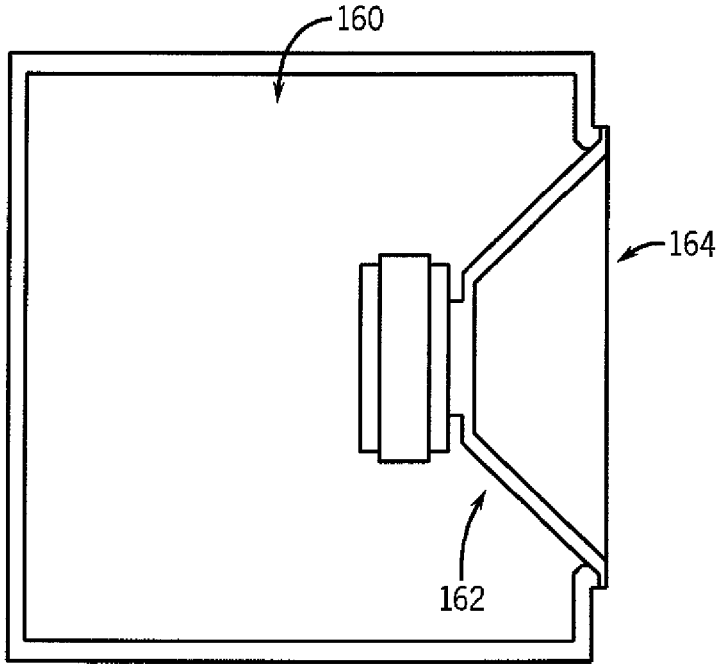
FIG. 11 is a schematic representation of a sealed enclosure and speaker arrangement for production of low frequency sounds in accordance with one aspect of the disclosure.

Infinite Baffle Closed-box Enclosures. FIG. 11 depicts one exemplary type of speaker chamber suitable for use with the disclosed devices. In this configuration, a sealed enclosure 160 generally presents a variation on an open baffle configuration. In this example, a speaker driver 162 is mounted in an opening 164 such that the sealed enclosure 160 is configured to have a suitably substantial size, thereby loading the driver 162 in a resonant system. The loudspeaker driver's mass and compliance, (i.e., the stiffness of the cone suspension) determines the driver's resonant frequency, and the damping properties of the system, both affect the low-frequency response of the speaker system. Output falls off below the cabinet resonant frequency (Fs), which can be determined by finding the peak impedance. The configuration may be designed for balanced bass response, flatness of frequency response, efficiency, and size of enclosure. The larger the resonant peak in the bass, the lower the speaker will reproduce its input evenly. The resulting low frequency performance of such speakers may be over-emphasized. Such enclosures are generally designed to be large enough such that the internal pressure reflections and resonances caused when the driver cone moves backwards into the cabinet does not rise too high and affect the cone's motion. The enclosure may be filled loosely with foam, pillow stuffing, long fiber wool, fiberglass, or other wadding, converting some of the speaker's thermodynamic properties from adiabatic to isothermal.

Closed-Box or Acoustic Suspension Enclosures. In a variation of the sealed enclosure, a closed-box or "acoustic suspension" enclosure may be utilized to avoid the effects of internal air pressure changes caused by cone motion. These designs generally use a smaller sealed enclosure. The enclosure has a very small leak so internal and external pressures can slowly equalize over time, allowing the speaker to adjust to changes in barometric pressure or altitude.

A spring-like suspension restores the cone to a neutral position. The suspension is a combination of a relatively soft mechanical suspension of the low frequency driver and mostly of the air inside the enclosure. At audible frequencies, the air pressure caused by the cone motion is the dominant force. Damping materials such as fiberglass may be added to the enclosure to shape system performance (i.e., damp) the driver/air volume resonance, and to absorb output (especially in the midrange) from the rear of the diaphragm. One advantage of a proper acoustic suspension design is that air is a more linear spring than is any practical mechanical cone suspension (i.e., cone surround and spider together)—they are inherently non-linear in many respects. This improved linearity gives acoustic suspension designs lower distortion than infinite baffle designs, particularly at the lower frequencies and higher power levels at which cone excursion is large. One drawback of these speakers is their low efficiency, due to the loss of the power absorbed inside the cabinet, combined with generally reduced transient response at low frequencies.

Figure 12:
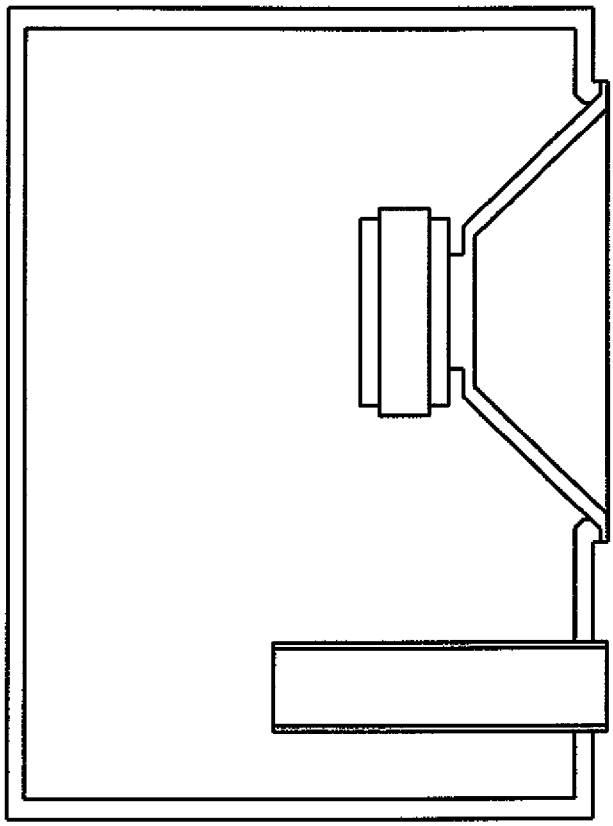
FIGS. 12-15 are schematic representations of further sealed enclosure and speaker arrangements that constitute alternative examples of production of low frequency sounds in accordance with the disclosure.

Bass Reflex Enclosures. With reference now to FIG. 12, other suitable types of enclosure configurations attempt to improve the low frequency response, or overall efficiency of the loudspeaker, or reduce the size of an enclosure, by using various combinations of cabinet openings or passive radiating elements to transmit low frequency energy from the rear of the speaker to the listener These enclosures are also referred to as vented, ported or bass reflex enclosures. The interiors of these enclosure may be lined with matting (e.g., fiberglass) for some of the same reasons as the sealed box speakers above, however, the entire volume is not stuffed with absorbent for two reasons. Air flows into and out of the port, but carrying bits of stuffing out the port may not be acceptable.

Reflex ports may be tuned by their diameter, length, and, to some extent, shape, all of which affect the mass and motion of the air within the vent and so the behavior of the driver and the sound the system. This enclosure type may also be suitable for smaller size and reasonable bass when tuned. Further design configuration details may be derived via the application of electrical filter theory to the acoustic behavior of speakers in enclosures.

Figure 13:
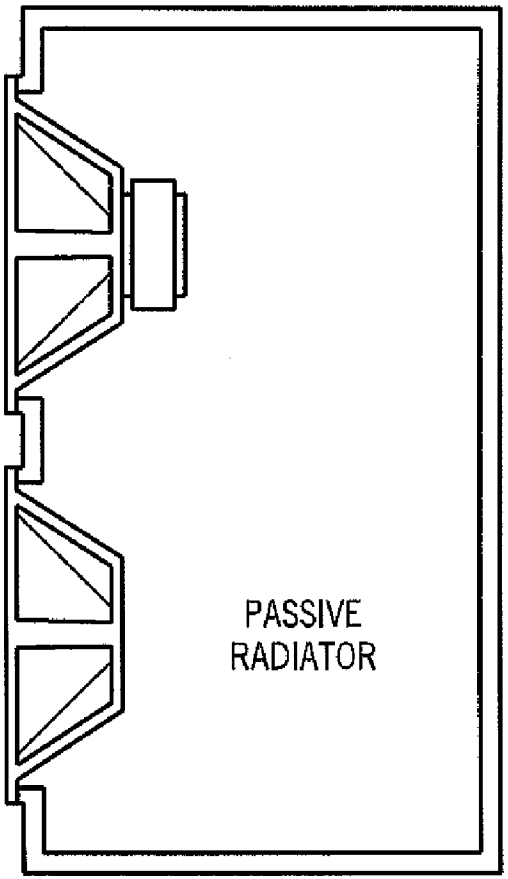

Passive Radiator Enclosures. Turning now to FIG. 13, a passive radiator speaker uses a second passive driver, or drone, to produce similar low frequency extension or efficiency increase or enclosure size reduction as do ported enclosures. Such enclosures may be considered variations of the bass reflex type, but with the advantage of avoiding a relatively small port or tube through which air moves, sometimes noisily. Moreover, tuning adjustments for a passive radiator may be easier, with the disadvantage that a passive radiator requires precision construction quite like driver design, thus increasing costs.

Figure 14:
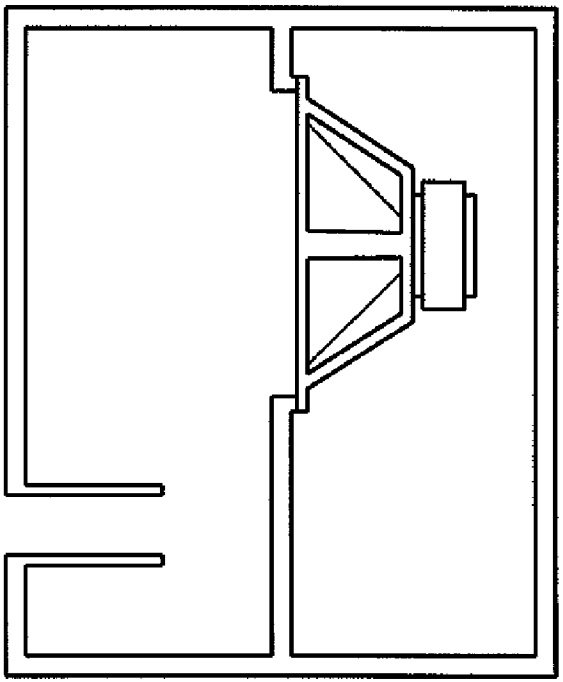

Compound or Bandpass Enclosures. FIG. 14 depicts a fourth-order bandpass enclosure configured in a similar manner to a vented box in which the contribution from the driver is trapped in a sealed box that modifies the resonance of the driver. Generally speaking, the configuration involves two chambers. The dividing wall between the chambers has the driver mounted on it and the panel opposite it (or the chamber into which the driver faces) is ported.

If the enclosure on each side of the woofer has a port in it then the enclosure yields a sixth-order bandpass response. This enclosure configuration may be considerably harder to design for a specific frequency response and tends to be very sensitive to the characteristics of the driver. As in other reflex enclosures, the ports may be replaced by passive radiators if desired.

Figure 15:
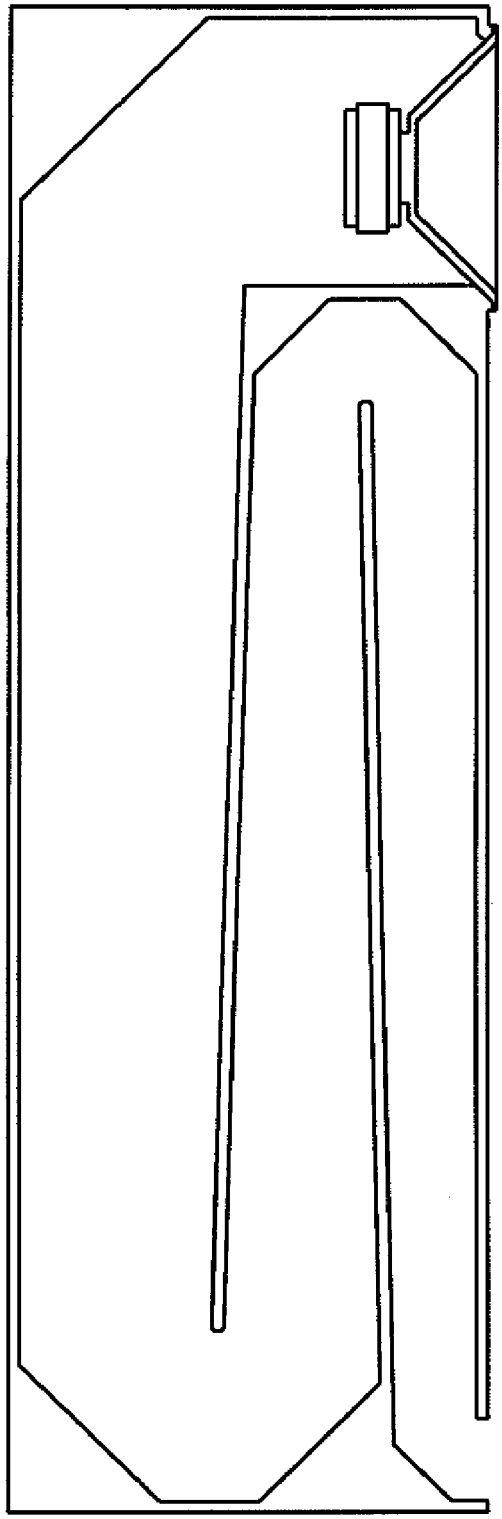

Transmission Line Enclosures. Turning now to FIG. 15, a transmission line enclosure includes a waveguide in which the structure shifts the phase of the driver's rear output by at least 90°, thereby reinforcing the frequencies near the driver's frequencies. Transmission lines may be larger than ported enclosures, due to the size and length of the guide required (typically ¼th the longest wavelength of interest). The design may be considered non-resonant, and some designs may be sufficiently stuffed with absorbent material that there is indeed not much output from the line's port. But an inherent resonance (typically at ¼ wavelength) can enhance the bass response in this type of enclosure, albeit with less absorbent stuffing.

Tapered Quarter-Wave Pipes. The tapered quarter-wave pipe (TQWP) is an example of a combination of transmission line and horn effects. In these cases, the sound emitted from the rear of the loudspeaker is progressively reflected and absorbed along the length of the tapering tube, almost completely preventing internally reflected sound being retransmitted through the cone of the loudspeaker. In essence it is a horn in reverse. Designs may involve large dimensions of the speaker and a rigid tapering tube. The tapering tube can be coiled for lower frequency driver enclosures to reduce the dimensions of the speaker resulting in a seashell like appearance.

Using one or more aspects of the foregoing enclosure designs, more accurate reproduction of womb sounds may be provided than previously available in infant products. More generally, the device and product designs described above are based on an integration of a better understanding of the frequency range of the sounds in a womb with a speaker and enclosure assembly of sufficient volume or other characteristic design to accurately reproduce these sounds.

Although described in connection with a child swing device, practice of the aspects of the disclosure is not limited to any particular type of child device or juvenile product. On the contrary, the aspects of the disclosure set forth above are well suited for a wide variety of infant child devices and juvenile products, including, without limitation, rockers, bouncers, car seats, bassinets, cradles, infant baskets and other beds, cribs, playards or play pens or mats, activity tables and platforms, and strollers.

Although certain devices and products have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A child soothing device comprising:

a frame comprising a structural support;

a housing coupled to the structural support and comprising a cover with an opening;

a speaker comprising a diaphragm and a speaker chamber, the diaphragm being disposed relative to the opening in the cover for external sound wave propagation via displacement of the diaphragm, and the speaker chamber having a volume defined by the housing and in communication with the diaphragm for internal sound wave propagation via the displacement of the diaphragm; and a partition within the housing to further define the volume of the speaker chamber;

wherein the speaker chamber is obliquely oriented relative to the diaphragm to support a low frequency response of the speaker.

2. The child soothing device of claim 1, wherein the partition comprises a wall positioned to isolate the speaker chamber from the structural support.

3. The child soothing device of claim 1, wherein the partition comprises a wall separating the speaker chamber from a space within the housing having a circuit board electronics for a user interface panel.

4. The child soothing device of claim 1, wherein the volume of the speaker chamber is greater than about 10 cubic inches.

5. The child soothing device of claim 1, wherein the volume of the speaker chamber is substantially empty.

6. The child soothing device of claim 1, wherein the partition comprises a wall having a smooth, curved surface to support the internal sound waves propagation within the speaker chamber.

7. The child soothing device of claim 1, wherein the partition comprises a wall oriented near the opening at an angle such that sound waves propagating into the speaker chamber from the diaphragm are aligned with the wall.

8. The child soothing device of claim 1, wherein the diaphragm is mounted near the opening in the cover.

9. The child soothing device of claim 1, wherein the volume is configured to support a range of frequencies predominantly produced in utero.

10. The child soothing device of claim 1, further comprising a speaker grill configured to cover the diaphragm and comprising a plurality of slots.

11. The child soothing device of claim 1, further comprising a plurality of walls within the housing, wherein the plurality of walls comprises the partition, and wherein at least two of the walls are joined by a fastener to establish an acoustic seal for the speaker chamber.

12. The child soothing device of claim 1, wherein the frame comprises the housing.

13. A child soothing device comprising:

a frame comprising a structural support;

a housing coupled to the structural support and comprising a cover with an opening;

a speaker comprising a diaphragm and a speaker chamber, the diaphragm being disposed relative to the opening in the cover for external sound wave propagation via displacement of the diaphragm, and the speaker chamber having a volume defined by the housing and in communication with the diaphragm for internal sound wave propagation via the displacement of the diaphragm; and a partition within the housing to further define the volume of the speaker chamber;

wherein the volume of the speaker chamber is greater than about 10 cubic inches to support a low frequency response of the speaker.

14. The child soothing device of claim 13, further comprising a plurality of walls disposed within the housing to further define the speaker chamber, wherein the plurality of walls comprises the partition.

15. The child soothing device of claim 14, wherein a first wall of the plurality of walls is positioned to isolate the speaker chamber from the structural support of the frame, and wherein a second wall of the plurality of walls is positioned to isolate the speaker chamber from control electronics.

* * * * *